US009151554B2

(12) United States Patent
Wei

(10) Patent No.: US 9,151,554 B2
(45) Date of Patent: Oct. 6, 2015

(54) HELICAL DRUM MAGAZINE

(71) Applicant: Yanwei Wei, Shandong (CN)

(72) Inventor: Yanwei Wei, Shandong (CN)

( * ) Notice: Subject to any disclaimer, the term of this patent is extended or adjusted under 35 U.S.C. 154(b) by 0 days.

(21) Appl. No.: 14/140,527

(22) Filed: Dec. 25, 2013

(65) Prior Publication Data

US 2015/0176935 A1 Jun. 25, 2015

(51) Int. Cl.
*F41A 9/61* (2006.01)
*F41A 9/73* (2006.01)
*F41A 9/75* (2006.01)

(52) U.S. Cl.
CPC .... *F41A 9/73* (2013.01); *F41A 9/75* (2013.01)

(58) Field of Classification Search
CPC ..... F41A 9/03; F41A 9/74; F41A 9/75; F41A 9/77; F41A 9/73; F42B 11/54; F41B 11/54
USPC ..... 42/49.01, 49.02, 50
See application file for complete search history.

(56) References Cited

U.S. PATENT DOCUMENTS 84,685 A * 12/1868 Evans ..... 42/49.01
2,064,888 A * 12/1936 Dickinson ..... 42/6
4,689,907 A * 9/1987 Gwinn, Jr. ..... 42/50
4,766,800 A * 8/1988 Miller et al. ..... 89/33.02
4,965,951 A * 10/1990 Miller et al. ..... 42/49.01
5,335,579 A * 8/1994 David ..... 89/34
5,816,444 A * 10/1998 David ..... 221/289
6,578,463 B1 * 6/2003 Ross, Jr. ..... 89/33.1
6,601,496 B1 * 8/2003 Kalashnikov et al. ..... 89/33.02
2012/0160083 A1 * 6/2012 Rael ..... 89/33.02

FOREIGN PATENT DOCUMENTS

CH 636434 A5 * 5/1983 ..... F41A 9/77
FR 2314467 A1 * 1/1977 ..... F41A 9/77

OTHER PUBLICATIONS

Machine Translation of CH 636434 A5. Tarauletti et al. May 1983.*

* cited by examiner

*Primary Examiner* — Gabriel Klein

(57) ABSTRACT

A magazine comprises: a shell, having an inner space in a shape of cylinder, wherein said shell has an opening, and bullets enters into or gets out of said magazine via said opening; a bullet limiting column, provided in said inner space, and coaxial with said inner space, wherein a bullet space is defined between said bullet limiting column and an inner wall of said shell; a bullet guide rail, winding around said bullet limiting column spirally, wherein a motion trail for said bullets to move along is defined; and a main spring, provided in said motion trail, wherein a first end of said main spring extends to said opening, when said bullets are put in said magazine, said bullets compress said main spring to said second end of said inner space, when said bullets are needed, said main spring pushes said bullets out of said magazine.

15 Claims, 6 Drawing Sheets

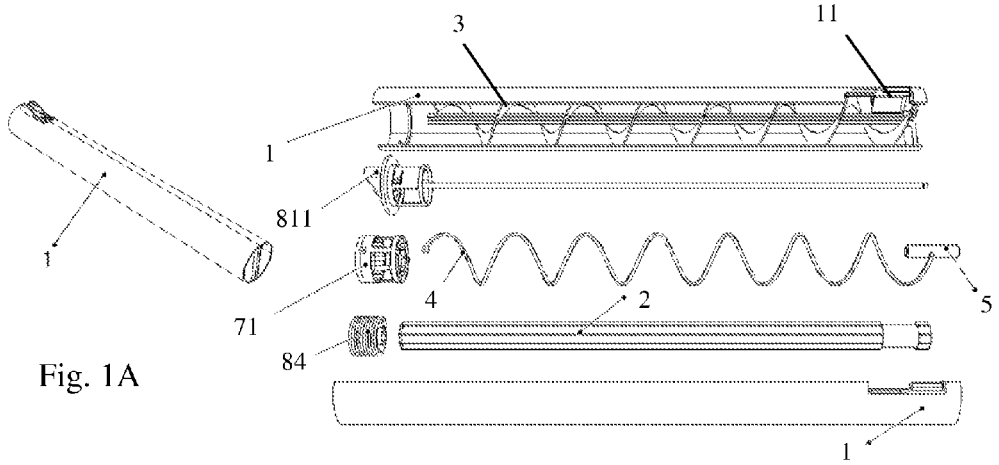
Fig. 1A
Fig. 1B
Fig. 2A
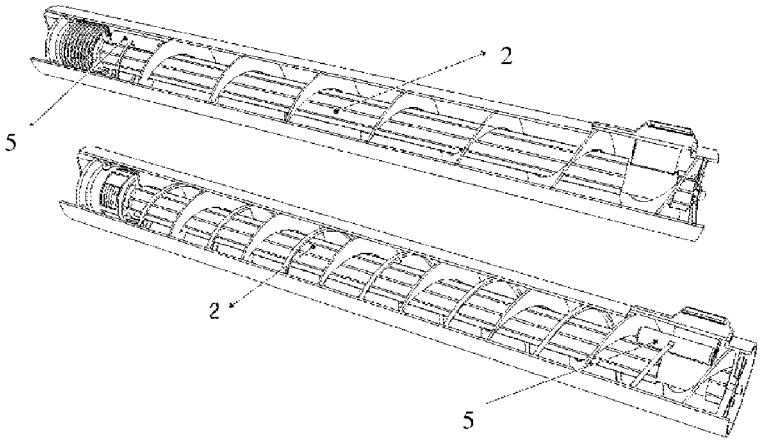
Fig. 2B

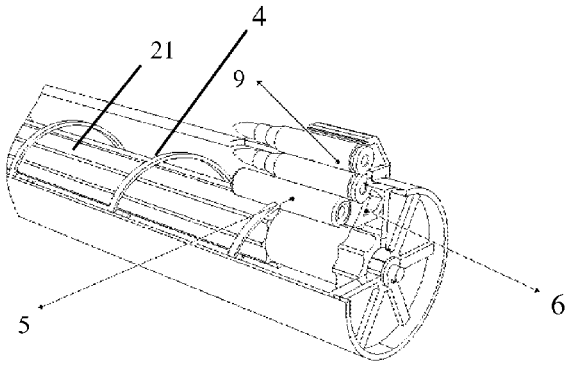
Fig. 5
Fig. 6A
Fig. 6B
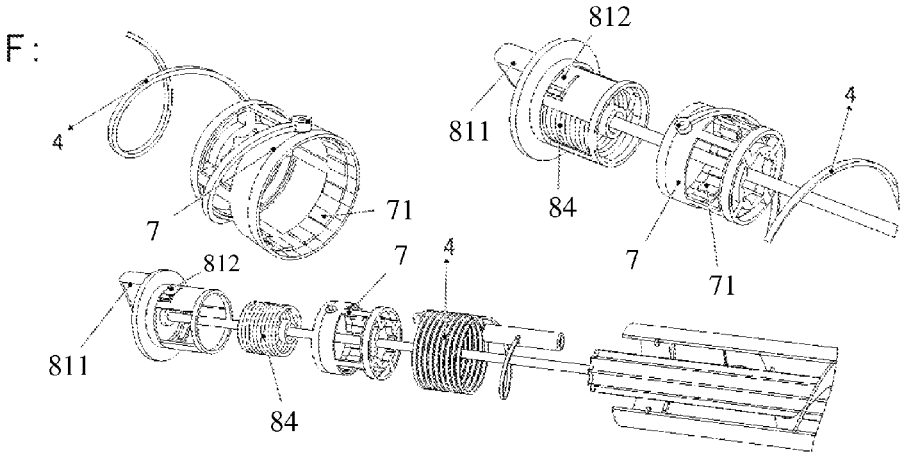
Fig. 6C

Fig. 7A
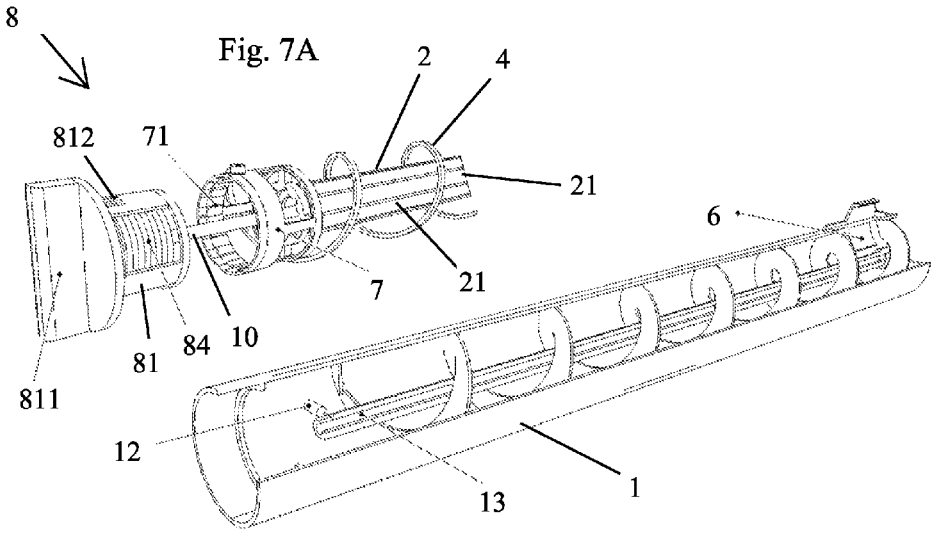
Fig. 7B
Fig. 8A
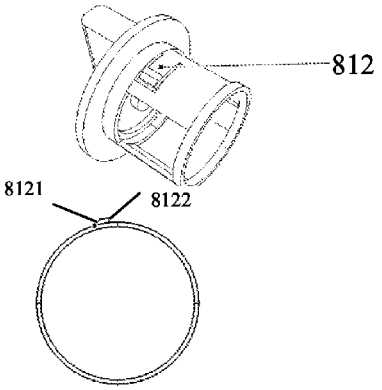
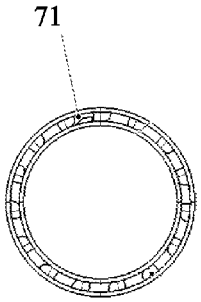
Fig. 8B
Fig. 8D

HELICAL DRUM MAGAZINE

BACKGROUND OF THE PRESENT INVENTION

1. Field of Invention

The present invention relates to a magazine, and more particularly to a helical drum magazine.

2. Description of Related Arts

Compared to the conventional magazine, the advantage of the drum magazine is that the ammunition capacity is large and the ammunitions are easy to carry. The ammunition capacity of one drum magazine is usually more than 100, but the ammunition capacity of the conventional magazine is only 30. If a soldier needs to carry 500 bullets to the battlefield, he just needs to carry 5 drum magazines rather than 16 conventional magazines. Nowadays, fire rates of firearms are mostly hundreds of rounds per minute, therefore, conventional magazines cannot meet demands of modern firearms in ammunition feed.

However, compared to the conventional magazine, the drum magazine has a more complicated structure. The mechanical structure of the firearms, such as gears, helps the drum magazine to feed the ammunition. This method of ammunition feed is complicated, and application range of the magazine is limited. Meanwhile, the firearms become more complicated.

The helical drum magazine in the present invention is designed to solve the above problems.

SUMMARY OF THE PRESENT INVENTION

An object of the present invention is to provide a helical drum magazine, which feeds ammunitions by a spring as a conventional magazine, but has a different structure from the conventional magazine. Compared to a conventional drum magazine, the helical drum magazine in the present invention comprises a spring to feed the ammunitions, rather than feeds the ammunitions with assistance of a mechanical structure of a firearm. Therefore, reliability of ammunition feed is increased, mechanical structures of the magazine is simplified to further simplify manufacturing process.

Accordingly, in order to accomplish the above objects, the present invention provides a magazine, comprising:

a shell, having an inner space in a shape of cylinder;

a bullet limiting column, which is in a shape of cylinder, provided in the inner space, and coaxial with the inner space, wherein a bullet space is defined between the bullet limiting column and an inner wall of the shell for receiving bullets;

a bullet guide rail, spirally winding around the bullet limiting column, wherein a moving channel for the bullets to move along is defined by the bullet guide rail in the bullet space, the moving channel has a first end and a second end, the shell has an opening, the first end of the moving channel is connected with external space through the opening, and bullets enters into or gets out of the magazine via the opening; and a first spring, provided in the moving channel, wherein a first end of the first spring is provided at the second end of the moving channel; when the magazine is empty, the first spring is relaxed, and a second end of the first spring extends to the first end of the moving channel; when the bullets are put in the magazine from the opening, the bullets push the second end of the first spring to move towards the first end of the first spring along the moving channel, in such a manner that the first spring is compressed; when the bullets are needed, because of an elastic force of the first spring, the second end of the first spring pushes the bullets to move towards the first end of the moving channel, and then get out of the magazine.

A helical drum magazine in the present invention comprises a spring to feed ammunitions. Therefore, mechanical structures and manufacturing process are simplified, and reliability of ammunition feed is increased.

These and other objectives, features, and advantages of the present invention will become apparent from the following detailed description, the accompanying drawings, and the appended claims.

BRIEF DESCRIPTION OF THE DRAWINGS

FIG. 1A is a perspective view of a magazine according to a preferred embodiment of the present invention.

FIG. 1B is an exploded view of the magazine according to the above preferred embodiment of the present invention.

FIG. 2A is a sketch view of the magazine when a first spring is compressed, according to the above preferred embodiment of the present invention.

FIG. 2B is a sketch view of the magazine when the first spring is relaxed, according to the above preferred embodiment of the present invention.

FIG. 5 is a partial view of the magazine showing a first end of a moving channel according to a preferred embodiment of the present invention.

FIG. 6A is a sketch view showing connection between a first rotator and the first spring according to the above preferred embodiment of the present invention.

FIG. 6B is a sketch view showing an auxiliary pushing device, the first rotator, an axle, and the first spring according to the above preferred embodiment of the present invention.

FIG. 6C is an exploded view showing a second end of the moving channel according to the above preferred embodiment of the present invention.

FIG. 7A is a sketch view of the auxiliary pushing device according to the above preferred embodiment of the present invention.

FIG. 7B is a sketch view showing a structure of the shell according to a preferred embodiment of the present invention.

FIG. 8A is a perspective view of a second rotator according to a preferred embodiment of the present invention.

FIG. 8B is a sectional view of the second rotator according to the above preferred embodiment of the present invention.

FIG. 8D is a sectional view of the first rotator and the second rotator according to the above preferred embodiment of the present invention.

DETAILED DESCRIPTION OF THE PREFERRED EMBODIMENT

Figure 3:
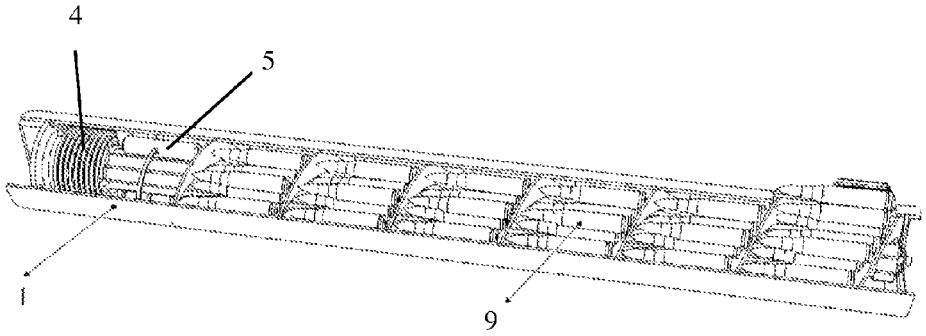
FIG. 3 is a sketch view of the magazine when the magazine is full of bullets, according to the above preferred embodiment of the present invention.

Referring to FIGS. 1A~3, a magazine comprises:

a shell 1, having an inner space in a shape of cylinder;

a bullet limiting column 2, which is in a shape of cylinder, provided in the inner space, and coaxial with the inner space, wherein a bullet space is defined between the bullet limiting column 2 and an inner wall of the shell 1 for receiving bullets 9;

a bullet guide rail 3, spirally winding around the bullet limiting column 2, wherein a moving channel for the bullets 9 to move along is defined by the bullet guide rail 3 in the bullet space, the moving channel has a first end and a second end, the shell has an opening 11, the first end of the moving channel is connected with external space through the opening 11, and bullets 9 enters into or gets out of the magazine via the opening 11; and a first spring 4, provided in the moving channel, wherein a first end of the first spring 4 is provided at the second end of the moving channel; when the magazine is empty, the first spring 4 is relaxed, and a second end of the first spring 4 extends to the first end of the moving channel; when the bullets 9 are put in the magazine from the opening 11, the bullets 9 push the second end of the first spring 4 to move towards the first end of the first spring 4 along the moving channel, in such a manner that the first spring 4 is compressed; when the bullets 9 are needed, because of an elastic force of the first spring 4, the second end of the first spring 4 pushes the bullets 9 to move towards the first end of the moving channel, and then get out of the magazine.

Figure 9:
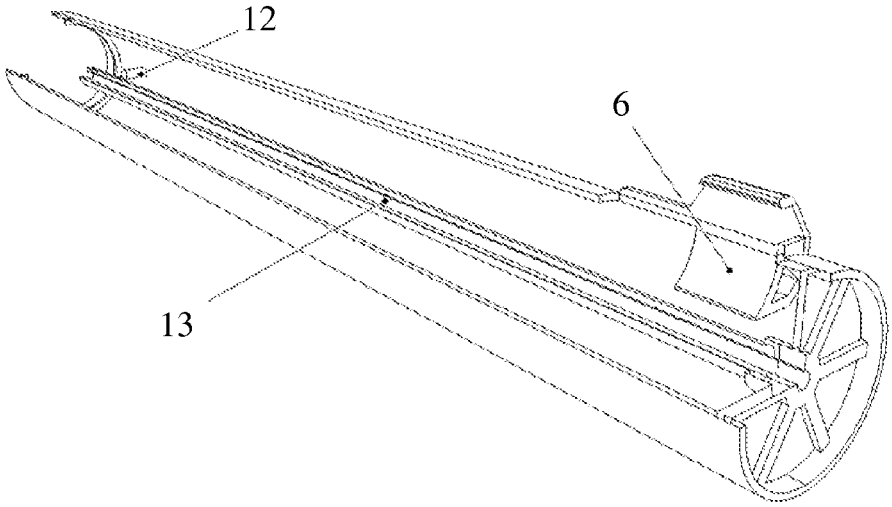
FIG. 9 is a sketch view of the shell according to a preferred embodiment of the present invention.

Referring to FIG. 1B and FIG. 9, the magazine further comprises an inclined plane 6, fixed at the opening 11, for leading the bullets to enter into the magazine in a direction of the moving channel.

Referring to FIG. 5, the magazine further comprises a bullet pusher 5, fixed on the first end of the first spring 4, able to move along the moving channel for maintaining gestures of the bullets 9 when moving.

Referring to FIG. 1B and FIG. 7A, the magazine further comprises:

an axle 10, provided at an axis of the bullet limiting column 2; and a first rotator 7, rotatably provided on the axle 10 and at the second end of the moving channel, wherein the first end of the first spring 4 is fixed on the first rotator 7, and is able to rotate about the axle 10 with the first rotator 7, in such a manner that when the second end of the first spring 4 is moving towards the first end of the first spring 4, the first spring 4 will not twist, and the first spring 4 is easy to compress.

Referring to FIG. 1B, FIG. 4A, FIG. 4B, and FIG. 6A~8D, the magazine further comprises an auxiliary pushing device 8, provided at the second end of the moving channel, for assisting the first spring 4 to push the bullets out of the magazine; wherein the auxiliary pushing device 8 comprises:

a second rotator 81, rotatably provided on the axle 10, having a handle 811 and a convex 812 and a second spring 84, wherein a first end of the second spring 84 is fixed on the second rotator 81, and able to rotate about the axle 10 with the second rotator 81; a second end of the second spring 84 is fixed on the shell 1 or the axle 10 not able to rotate; after the magazine is loaded, a user rotates the second rotator 81 by the handle 811 in a first direction, and the first end of the second spring 84 rotates about the axle 10 in the first direction, in such a manner that the second spring 84 is deformed, and elastic potential energy thereof is increased; when the bullets are needed, because of an elastic force of the second spring 84, the first end of the second spring 84 rotates about the axle 10 in a second direction, in order to drive the second rotator 81 to rotate in the second direction;

the first rotator 7 has a plurality of concaves 71, provided around the axle 10 and evenly spaced; wherein the concaves 71 are able to rotate about the axle 10 with the first rotator 7; the concaves 71 are for receiving the convex 812; the convex 812 has a convex inclined plane 8121 and a convex vertical plane 8122, respectively provided at two sides thereof; each of the concaves 71 has a concave inclined plane 711 provided at a first side thereof, and a concave vertical plane 712 provided at a second side thereof; the convex 812 is flexible; when the convex 812 is relaxed, the convex 812 is received in any one of the concaves 71; the convex inclined plane 8121 is opposite to the concave inclined plane 711, and the convex vertical plane 8122 is opposite to the concave vertical plane 712; the convex inclined plane 8121 matches with the concave inclined plane 711; when the second rotator 81 rotates in the first direction, the convex inclined plane 8121 and the concave inclined plane 711 slide relative to each other, and then the convex 812 is deformed, gets out of one concave 71, and slide into a next concave 71 in the first direction, in such a manner that the first rotator 7 stays still, i.e., the second rotator rotates relative to the first rotator in the first direction; when the second rotator 81 rotates in the second direction, the convex vertical plane 8122 and the concave vertical plane 712 resist with each other, in such a manner that the second rotator 81 drives the first rotator 7 to rotate in the second direction, in order to assist the first spring 4 to push the bullets out of the magazine.

Figure 4A:
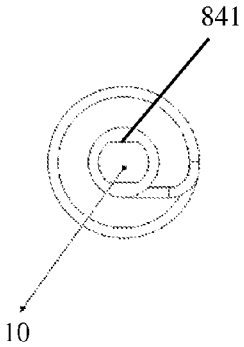
FIG. 4A is a sectional view of a second spring according to a preferred embodiment of the present invention.
Figure 4B:
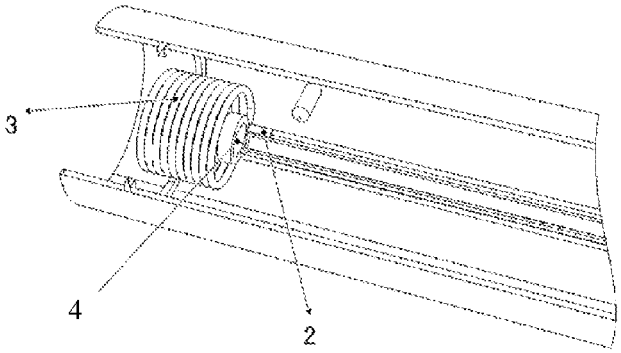
FIG. 4B is a sketch view showing connection between the second spring and a shell of the magazine according to a preferred embodiment of the present invention.
Figure 8C:
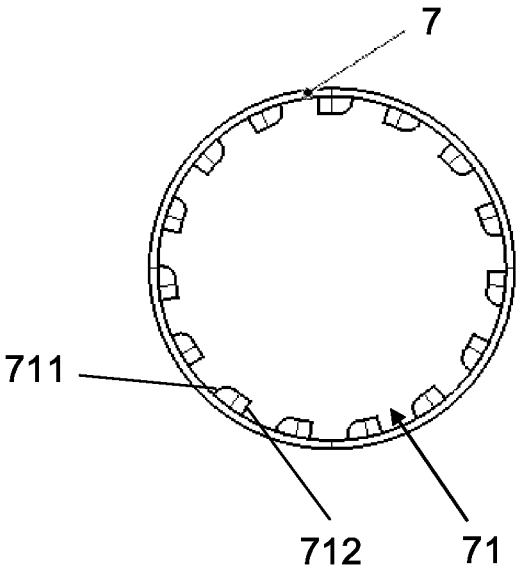
FIG. 8C is a sectional view of the first rotator according to the above preferred embodiment of the present invention.

Referring to FIG. 4A, preferably, a section the axle 10 is non-circular, and the second spring 84 further comprises a second fixer 841 provided at the second end thereof, matching with the axle 10, and coating on the axle 10, in such a manner that the second end of the second spring 84 is not able to rotate about the axle 10.

Referring to FIG. 1B and FIG. 5, preferably, the bullet limiting column 2 has a plurality of bullet grooves 21, provided on a surface of the bullet limiting column 2 and evenly spaced around an axis of the bullet limiting column 2, for limiting relative positions of the bullets 9 to the bullet limiting column 2; and the bullet limiting column 2 is able to rotate about the axis.

Referring to FIG. 7A, preferably, the bullet limiting column has a plurality of bullet grooves 21, provided on a surface of the bullet limiting column 2 and evenly spaced around an axis of the bullet limiting column 2, for limiting relative positions of the bullets to the bullet limiting column 2; the bullet limiting column 2 is able to rotate about the axle 10; and one end of the bullet limiting column 2 is fixedly connected with the first rotator 7, in such a manner the bullet limiting column 2 and the first rotator 7 rotate synchronously about the axle 10.

Referring to FIG. 7B and FIG. 9, the shell 1 further comprises a first fixer 12 for fixing the first end of the first spring; and an axle holder 13 for receiving the axle 10.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A magazine, comprising:

a shell, having an inner space in a shape of a cylinder;

a bullet limiting column, which is in a shape of a cylinder, provided in said inner space, and coaxial with said inner space, wherein a bullet space is defined between said bullet limiting column and an inner wall of said shell for receiving bullets;

a bullet guide rail, spirally winding around said bullet limiting column, wherein a moving channel for said bullets to move along is defined by said bullet guide rail in said bullet space, said moving channel has a first end and a second end, said shell has an opening, said first end of said moving channel is connected with external space through said opening, and bullets enter into or exit out of said magazine via said opening;

a first spring, provided in said moving channel, wherein a first end of said first spring is provided at said second end of said moving channel; when said magazine is empty, said first spring is relaxed, and a second end of said first spring extends to said first end of said moving channel; when said bullets are put in said magazine from said opening, said bullets push said second end of said first spring to move towards said first end of said first spring along said moving channel, in such a manner that said first spring is compressed; when said bullets are needed, because of an elastic force of said first spring, said second end of said first spring pushes said bullets to move towards said first end of said moving channel, and then exit out of said magazine;

an axle, provided at an axis of said bullet limiting column; and a first rotator, rotatably provided on said axle and at said second end of said moving channel, wherein said first end of said first spring is fixed on said first rotator, and is able to rotate about said axle with said first rotator, in such a manner that when said second end of said first spring is moving towards said first end of said first spring, said first spring will not twist.

2. The magazine, as recited in claim 1, further comprising an auxiliary pushing device, provided at said second end of said moving channel, for assisting said first spring to push said bullets out of said magazine; wherein said auxiliary pushing device comprises:

a second rotator, rotatably provided on said axle, having a handle and a convex; and a second spring, wherein a first end of said second spring is fixed on said second rotator, and able to rotate about said axle with said second rotator; a second end of said second spring is fixed on said axle, which is not able to rotate; after said magazine is loaded, a user rotates said second rotator by said handle in a first direction, and said first end of said second spring rotates about said axle in said first direction, in such a manner that said second spring is deformed, and elastic potential energy thereof is increased; when said bullets are needed, because of an elastic force of said second spring, said first end of said second spring rotates about said axle in a second direction, in order to drive said second rotator to rotate in said second direction;

wherein said first rotator has a plurality of concaves, provided around said axle and evenly spaced; wherein said concaves are able to rotate about said axle with said first rotator; said concaves are for receiving said convex; said convex has a convex inclined plane and a convex vertical plane, respectively provided at two sides thereof; each of said concaves has a concave inclined plane provided at a first side thereof, and a vertical plane provided at a second side thereof; said convex is flexible; when said convex is relaxed, said convex is received in any one of said concaves; said convex inclined plane is opposite to said concave inclined plane, and said convex vertical plane is opposite to said concave vertical plane; said convex inclined plane matches with said concave inclined plane; when said second rotator rotates in said first direction, said convex inclined plane and said concave inclined plane slide relative to each other, and then said convex is deformed, moves out of one concave, and slides into an adjacent concave in said first direction, in such a manner that said first rotator stays still, such that said second rotator rotates relative to said first rotator in said first direction; when said second rotator rotates in said second direction, said convex vertical plane and said concave vertical plane resist with each other, in such a manner that said second rotator drives said first rotator to rotate in said second direction, in order to assist said first spring to push said bullet out of said magazine.

3. The magazine, as recited in claim 2, wherein said bullet limiting column has a plurality of bullet grooves, provided on a surface of said bullet limiting column and evenly spaced around an axis of said bullet limiting column, for limiting relative positions of said bullets to said bullet limiting column; and said bullet limiting column is able to rotate about said axis.

4. The magazine, as recited in claim 2, wherein said bullet limiting column has a plurality of bullet grooves, provided on a surface of said bullet limiting column and evenly spaced around an axis of said bullet limiting column, for limiting relative positions of said bullets to said bullet limiting column; said bullet limiting column is able to rotate about said axle; and one end of said bullet limiting column is fixedly connected with said first rotator, in such a manner said bullet limiting column and said first rotator rotate synchronously about said axle.

5. The magazine, as recited in claim 1, wherein said bullet limiting column has a plurality of bullet grooves, provided on a surface of said bullet limiting column and evenly spaced around an axis of said bullet limiting column, for limiting relative positions of said bullets to said bullet limiting column; and said bullet limiting column is able to rotate about said axis.

6. The magazine, as recited in claim 5, wherein said bullet limiting column has a plurality of bullet grooves, provided on a surface of said bullet limiting column and evenly spaced around an axis of said bullet limiting column, for limiting relative positions of said bullets to said bullet limiting column; said bullet limiting column is able to rotate about said axle; and one end of said bullet limiting column is fixedly connected with said first rotator, in such a manner said bullet limiting column and said first rotator rotate synchronously about said axle.

7. The magazine, as recited in claim 1, wherein said bullet limiting column has a plurality of bullet grooves, provided on a surface of said bullet limiting column and evenly spaced around an axis of said bullet limiting column, for limiting relative positions of said bullets to said bullet limiting column; said bullet limiting column is able to rotate about said axle; and one end of said bullet limiting column is fixedly connected with said first rotator, in such a manner said bullet limiting column and said first rotator rotate synchronously about said axle.

8. The magazine, as recited in claim 1, further comprising an inclined plane, fixed at said opening, for leading said bullets to enter into said magazine in a direction of said moving channel.

9. The magazine, as recited in claim 8, further comprising a bullet pusher, fixed on said first end of said first spring, able to move along said moving channel for maintaining gestures of said bullets when moving.

10. The magazine, as recited in claim 9, further comprising an auxiliary pushing device, provided at said second end of said moving channel, for assisting said first spring to push said bullets out of said magazine; wherein said auxiliary pushing device comprises:

a second rotator, rotatably provided on said axle, having a handle and a convex; and a second spring, wherein a first end of said second spring is fixed on said second rotator, and able to rotate about said axle with said second rotator; a second end of said second spring is fixed on said axle, which is not able to rotate; after said magazine is loaded, a user rotates said second rotator by said handle in a first direction, and said first end of said second spring rotates about said axle in said first direction, in such a manner that said second spring is deformed, and elastic potential energy thereof is increased; when said bullets are needed, because of an elastic force of said second spring, said first end of said second spring rotates about said axle in a second direction, in order to drive said second rotator to rotate in said second direction;

wherein said first rotator has a plurality of concaves, provided around said axle and evenly spaced; wherein said concaves are able to rotate about said axle with said first rotator; said concaves are for receiving said convex; said convex has a convex inclined plane and a convex vertical plane, respectively provided at two sides thereof; each of said concaves has a concave inclined plane provided at a first side thereof, and a vertical plane provided at a second side thereof; said convex is flexible; when said convex is relaxed, said convex is received in any one of said concaves; said convex inclined plane is opposite to said concave inclined plane, and said convex vertical plane is opposite to said concave vertical plane; said convex inclined plane matches with said concave inclined plane; when said second rotator rotates in said first direction, said convex inclined plane and said concave inclined plane slide relative to each other, and then said convex is deformed, moves out of one concave, and slides into an adjacent concave in said first direction, in such a manner that said first rotator stays still, such that said second rotator rotates relative to said first rotator in said first direction; when said second rotator rotates in said second direction, said convex vertical plane and said concave vertical plane resist with each other, in such a manner that said second rotator drives said first rotator to rotate in said second direction, in order to assist said first spring to push said bullet out of said magazine.

11. The magazine, as recited in claim 8, further comprising an auxiliary pushing device, provided at said second end of said moving channel, for assisting said first spring to push said bullets out of said magazine; wherein said auxiliary pushing device comprises:

a second rotator, rotatably provided on said axle, having a handle and a convex; and a second spring, wherein a first end of said second spring is fixed on said second rotator, and able to rotate about said axle with said second rotator; a second end of said second spring is fixed on said axle, which is not able to rotate; after said magazine is loaded, a user rotates said second rotator by said handle in a first direction, and said first end of said second spring rotates about said axle in said first direction, in such a manner that said second spring is deformed, and elastic potential energy thereof is increased; when said bullets are needed, because of an elastic force of said second spring, said first end of said second spring rotates about said axle in a second direction, in order to drive said second rotator to rotate in said second direction;

wherein said first rotator has a plurality of concaves, provided around said axle and evenly spaced; wherein said concaves are able to rotate about said axle with said first rotator; said concaves are for receiving said convex; said convex has a convex inclined plane and a convex vertical plane, respectively provided at two sides thereof; each of said concaves has a concave inclined plane provided at a first side thereof, and a vertical plane provided at a second side thereof; said convex is flexible; when said convex is relaxed, said convex is received in any one of said concaves; said convex inclined plane is opposite to said concave inclined plane, and said convex vertical plane is opposite to said concave vertical plane; said convex inclined plane matches with said concave inclined plane; when said second rotator rotates in said first direction, said convex inclined plane and said concave inclined plane slide relative to each other, and then said convex is deformed, moves out of one concave, and slides into an adjacent concave in said first direction, in such a manner that said first rotator stays still, such that said second rotator rotates relative to said first rotator in said first direction; when said second rotator rotates in said second direction, said convex vertical plane and said concave vertical plane resist with each other, in such a manner that said second rotator drives said first rotator to rotate in said second direction, in order to assist said first spring to push said bullet out of said magazine.

12. The magazine, as recited in claim 8, wherein said bullet limiting column has a plurality of bullet grooves, provided on a surface of said bullet limiting column and evenly spaced around an axis of said bullet limiting column, for limiting relative positions of said bullets to said bullet limiting column; and said bullet limiting column is able to rotate about said axis.

13. The magazine, as recited in claim 8, wherein said bullet limiting column has a plurality of bullet grooves, provided on a surface of said bullet limiting column and evenly spaced around an axis of said bullet limiting column, for limiting relative positions of said bullets to said bullet limiting column; said bullet limiting column is able to rotate about said axle; and one end of said bullet limiting column is fixedly connected with said first rotator, in such a manner said bullet limiting column and said first rotator rotate synchronously about said axle.

14. The magazine, as recited in claim 1, further comprising a bullet pusher, fixed on said first end of said first spring, able to move along said moving channel for maintaining gestures of said bullets when moving.

15. The magazine, as recited in claim 14, further comprising an auxiliary pushing device, provided at said second end of said moving channel, for assisting said first spring to push said bullets out of said magazine; wherein said auxiliary pushing device comprises:

a second rotator, rotatably provided on said axle, having a handle and a convex; and a second spring, wherein a first end of said second spring is fixed on said second rotator, and able to rotate about said axle with said second rotator; a second end of said second spring is fixed on said axle, which is not able to rotate; after said magazine is loaded, a user rotates said second rotator by said handle in a first direction, and said first end of said second spring rotates about said axle in said first direction, in such a manner that said second spring is deformed, and elastic potential energy thereof is increased; when said bullets are needed, because of an elastic force of said second spring, said first end of said second spring rotates about said axle in a second direction, in order to drive said second rotator to rotate in said second direction;

wherein said first rotator has a plurality of concaves, provided around said axle and evenly spaced; wherein said concaves are able to rotate about said axle with said first rotator; said concaves are for receiving said convex; said convex has a convex inclined plane and a convex vertical plane, respectively provided at two sides thereof; each of said concaves has a concave inclined plane provided at a first side thereof, and a vertical plane provided at a second side thereof; said convex is flexible; when said convex is relaxed, said convex is received in any one of said concaves; said convex inclined plane is opposite to said concave inclined plane, and said convex vertical plane is opposite to said concave vertical plane; said convex inclined plane matches with said concave inclined plane; when said second rotator rotates in said first direction, said convex inclined plane and said concave inclined plane slide relative to each other, and then said convex is deformed, moves out of one concave, and slides into an adjacent concave in said first direction, in such a manner that said first rotator stays still, such that said second rotator rotates relative to said first rotator in said first direction; when said second rotator rotates in said second direction, said convex vertical plane and said concave vertical plane resist with each other, in such a manner that said second rotator drives said first rotator to rotate in said second direction, in order to assist said first spring to push said bullet out of said magazine.

* * * * *